US007918321B2

(12) United States Patent
Sakurai

(10) Patent No.: US 7,918,321 B2
(45) Date of Patent: Apr. 5, 2011

(54) CONTROL SYSTEM FOR ELEVATORS

(75) Inventor: Susumu Sakurai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 376 days.

(21) Appl. No.: 12/067,720

(22) PCT Filed: Feb. 21, 2006

(86) PCT No.: PCT/JP2006/303041

§ 371 (c)(1),
(2), (4) Date: Mar. 21, 2008

(87) PCT Pub. No.: WO2007/096947

PCT Pub. Date: Aug. 30, 2007

(65) Prior Publication Data

US 2009/0178890 A1 Jul. 16, 2009

(51) Int. Cl.
*B66B 1/18* (2006.01)

(52) U.S. Cl. ..... 187/382; 187/384; 187/387; 187/391

(58) Field of Classification Search ..... 187/247, 187/380–389, 391–396, 316
See application file for complete search history.

(56) References Cited

U.S. PATENT DOCUMENTS

| | | | | |
|---|---|---|---|---|
| 5,411,118 | A * | 5/1995 | Thangavelu et al. | 187/392 |
| 6,397,976 | B1 * | 6/2002 | Hale et al. | 187/392 |
| 6,945,365 | B2 * | 9/2005 | Matela | 187/382 |
| 7,328,775 | B2 * | 2/2008 | Zaharia et al. | 187/396 |
| 7,717,238 | B2 * | 5/2010 | Hamaji et al. | 187/396 |
| 2009/0120726 | A1 * | 5/2009 | Stanley et al. | 187/382 |

FOREIGN PATENT DOCUMENTS

| | | |
|---|---|---|
| JP | 4 226286 | 8/1992 |
| JP | 5 78068 | 3/1993 |
| JP | 6 72644 | 3/1994 |
| JP | 11 71080 | 3/1999 |
| JP | 3040524 | 3/2000 |
| JP | 2002 220177 | 8/2002 |

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

A control system for elevators is provided with a landing call registration device provided at each of landing floors so as to be operable thereat, a landing call automatic registration portion for setting that one of the landing floors at which the landing call registration device is operated as a car call floor and registering a car call to stop one of cars at the car call floor, a response selection portion for selecting that one of elevator apparatuses which responds to a registered car call as a selected elevator, a passenger traveling time period calculation portion for setting that one of elevator doorways of the selected elevator which is provided at the car call floor as a selected doorway and calculating a passenger traveling time period corresponding to the selected doorway, and an opening/closing control portion for controlling the opening/closing operation of the selected doorway based on information from the selected elevator and information from the passenger traveling time period calculation portion. When the selected doorway is already in a door-open state at the time of registration of the car call, the opening/closing control portion continues to hold the selected doorway in the door-open state until the passenger traveling time period elapses after registration of the car call.

7 Claims, 11 Drawing Sheets

CONTROL SYSTEM FOR ELEVATORS

TECHNICAL FIELD

The present invention relates to a control system for elevators for controlling operations of elevator apparatuses.

BACKGROUND ART

Conventionally, there has been proposed an elevator group control device for supervising traveling of a plurality of elevator apparatuses as a group. In a building provided with this conventional elevator group control device, elevator doorways corresponding to each of the elevator apparatuses are provided at each single floor. A call registration command device, which is operated by passengers to call cars, is provided at that floor. When the call registration command device is operated, the allocation of those of the cars which are to be moved to that floor is carried out.

The allocation of the cars is carried out by comparing time periods required until the arrival of the cars at that floor with time periods required until the arrival of passengers at the elevator doorways. In this case, when the time period required until the arrival of a certain one of the cars at that floor is shorter than the time period required until the arrival of a passenger at a corresponding one of the elevator doorways, this elevator doorway is excluded from targets for allocation. Thus, that one of the cars which arrives after the arrival of the passenger at the elevator doorway can be allocated, so the passenger is prevented from missing that car (see Patent Document 1).

Patent Document 1: P 3040524

DISCLOSURE OF THE INVENTION

Problem to be Solved by the Invention

However, in the conventional elevator group control device, those of the cars which can arrive before a passenger arrives at each of the elevator doorways are excluded from allocated objects. Therefore, even when, for example, one of the cars is stopped at that floor and the other cars are located far from that floor and take a long time to arrive at that floor, those cars located far from that floor are allocated. As a result, the passenger can arrive at each of the elevator doorways before those cars arrive at that floor. However, the passenger must wait for the arrival of those cars in front of each of the elevator doorways for a long time.

The present invention has been made to solve the above-mentioned problem, and it is therefore an object of the present invention to provide a control system for elevators which makes it possible to shorten the waiting time periods of passengers and prevent the passengers from missing cars.

Means for Solving the Problem

A control system for elevators according to the present invention controls operations of a plurality of elevator apparatuses each having a corresponding one of cars that can be stopped at common landing floors and corresponding ones of elevator doorways each provided at a corresponding one of the landing floors to serve for a transfer between the corresponding one of the cars stopped at the corresponding one of the landing floors and this landing floor. The control system includes: a landing call registration device provided at each of the landing floors so as to be operable thereat; a landing call automatic registration portion for setting that one of the landing floors at which the landing call registration device is operated as a car call floor, and registering a car call to stop any one of the cars at the car call floor; a response selection portion for selecting, based on information from each of the elevator apparatuses and information from the landing call automatic registration portion, that one of the elevator apparatuses which responds to the registered car call as a selected elevator; a passenger traveling time period calculation portion for setting, based on information from the response selection portion, that one of the elevator doorways of the selected elevator which is provided at the car call floor as a selected doorway, and calculating a passenger traveling time period required for traveling of a passenger from the landing call registration device to the selected doorway; and an opening/closing control portion for controlling an opening/closing operation of the selected doorway based on information from the selected elevator and information from the passenger traveling time period calculation portion. The opening/closing control portion continues to hold the selected doorway in a door-open state until the passenger traveling time period elapses after registration of the car call when the selected doorway is already in the door-open state at a time of registration of the car call.

BEST MODES FOR CARRYING OUT THE INVENTION

Preferred embodiments of the present invention will be described hereinafter with reference to the drawings.

Embodiment 1

Figure 1:
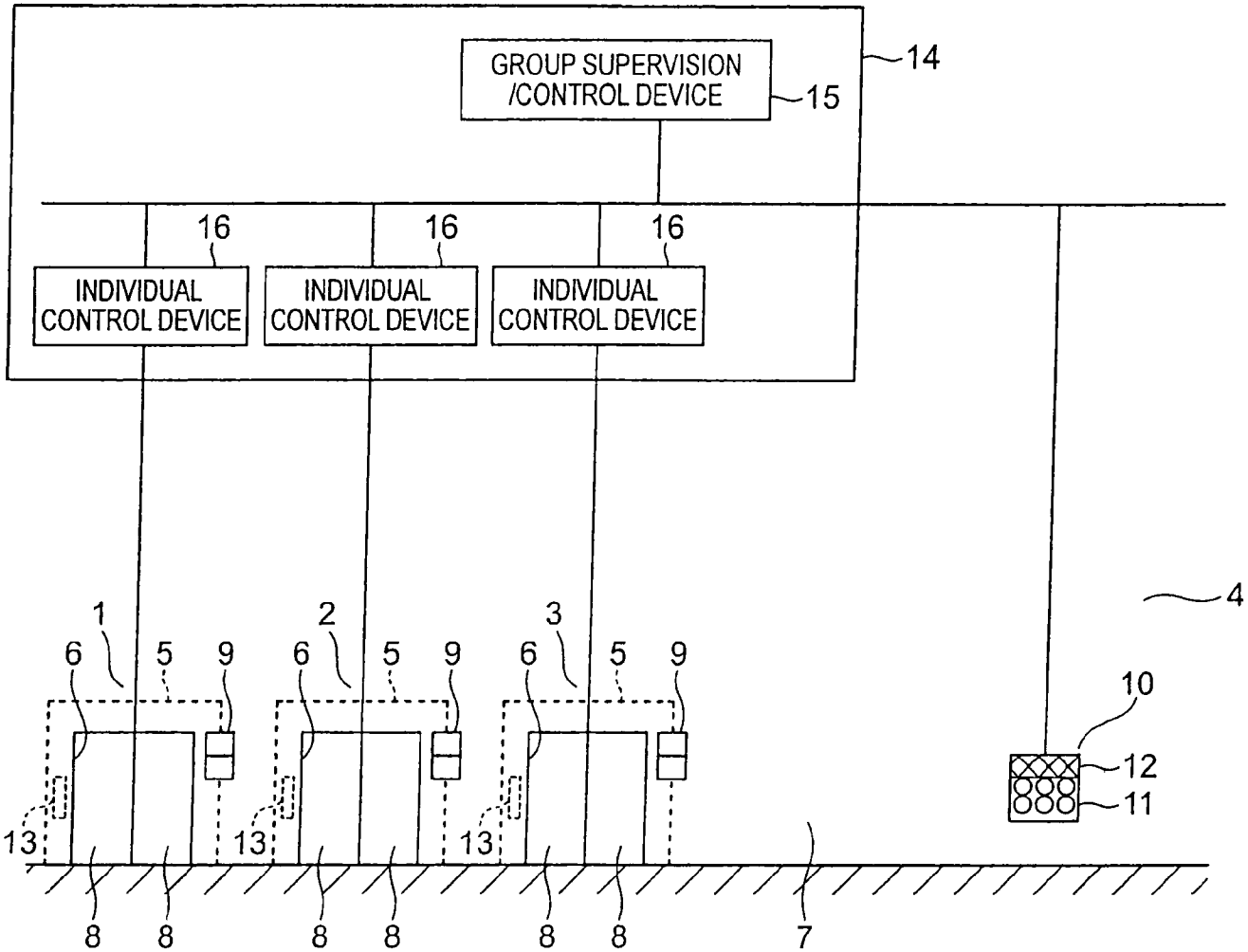
FIG. 1 is a schematic diagram showing a control system for elevators according to Embodiment 1 of the present invention.

FIG. 1 is a schematic diagram showing a control system for elevators according to Embodiment 1 of the present invention. Referring to FIG. 1, a building is provided with a plurality of (three in this example) elevator apparatuses 1 to 3. The building is also provided with a plurality of landing floors 4 where the elevator apparatuses 1 to 3 can be used. The elevator apparatuses 1 to 3 each have a car 5 and an elevator doorway 6. The cars 5 can stop at the landing floors 4. The elevator doorways 6 are provided at each of the landing floors 4 so that passengers can get on/off the cars 5 from/to each of the landing floors 4.

An elevator hall 7 is provided at each of the landing floors 4. The elevator doorways 6 of the elevator apparatuses 1 to 3 are provided horizontally apart from one another in the elevator hall 7. Each of the elevator doorways 6 is provided with a pair of elevator doors 8 for opening/closing the elevator doorway 6.

A plurality of (three in this example) hall lanterns 9 for reporting to the elevator hall 7 that one of the elevator doorways 6 which is to be opened subsequently and the arrival of the corresponding one of the cars 5 are provided at each of the landing floors 4. Each of the hall lanterns 9 is provided in the vicinity of a corresponding one of the elevator doorways 6. In this example, that one of the elevator doorways 6 which is to be opened is reported through the lighting of the corresponding one of the hall lanterns 9, and the arrival of the corresponding one of the cars 5 is reported through the blinking of the corresponding one of the hall lanterns 9.

Provided at each of the landing floors 4 is a landing call registration device 10 that can be operated there. In this example, the landing call registration device 10 is installed at a hall doorway through which passengers get into/out of the elevator hall 7. The landing call registration device 10 is provided with a destination floor selector 11 for selecting target floors through the operations by passengers, and an indicator 12 for indicating the target floors selected by the passengers. The target floor selector 11 has a general-purpose selector designed for the selection of target floors by able-bodied persons, and a disabled-accessible selector disposed below the general-purpose selector to help disabled persons such as wheelchair users to select target floors. Each of the general-purpose selector and the disabled-accessible selector is provided with a plurality of target floor buttons.

Provided in the car 5 of each of the elevator apparatuses 1 to 3 is an in-car call registration device 13 that can be operated therein. The in-car call registration device 13 is provided with a destination floor selector (not shown) for selecting destination floors of the car 5 through the operation by passengers, and an indicator (not shown) for indicating the current position of the car 5. The destination floor selector is provided with a plurality of destination floor buttons.

Information from the landing call registration device 10 and information from the elevator apparatuses 1 to 3 are transmitted to a control system body 14 for controlling the operations of the elevator apparatuses 1 to 3 comprehensively. The control system body 14 controls the operations of the elevator apparatuses 1 to 3 based on the information from the landing call registration device 10 and the information from the elevator apparatuses 1 to 3.

The control system body 14 has a group supervision/control device 15 for operating and supervising the elevator apparatuses 1 to 3 as a group, and a plurality of (three in this example) individual control devices 16 for controlling the operations of the elevator apparatuses 1 to 3 individually based on information from the group supervision/control device 15.

Figure 2:
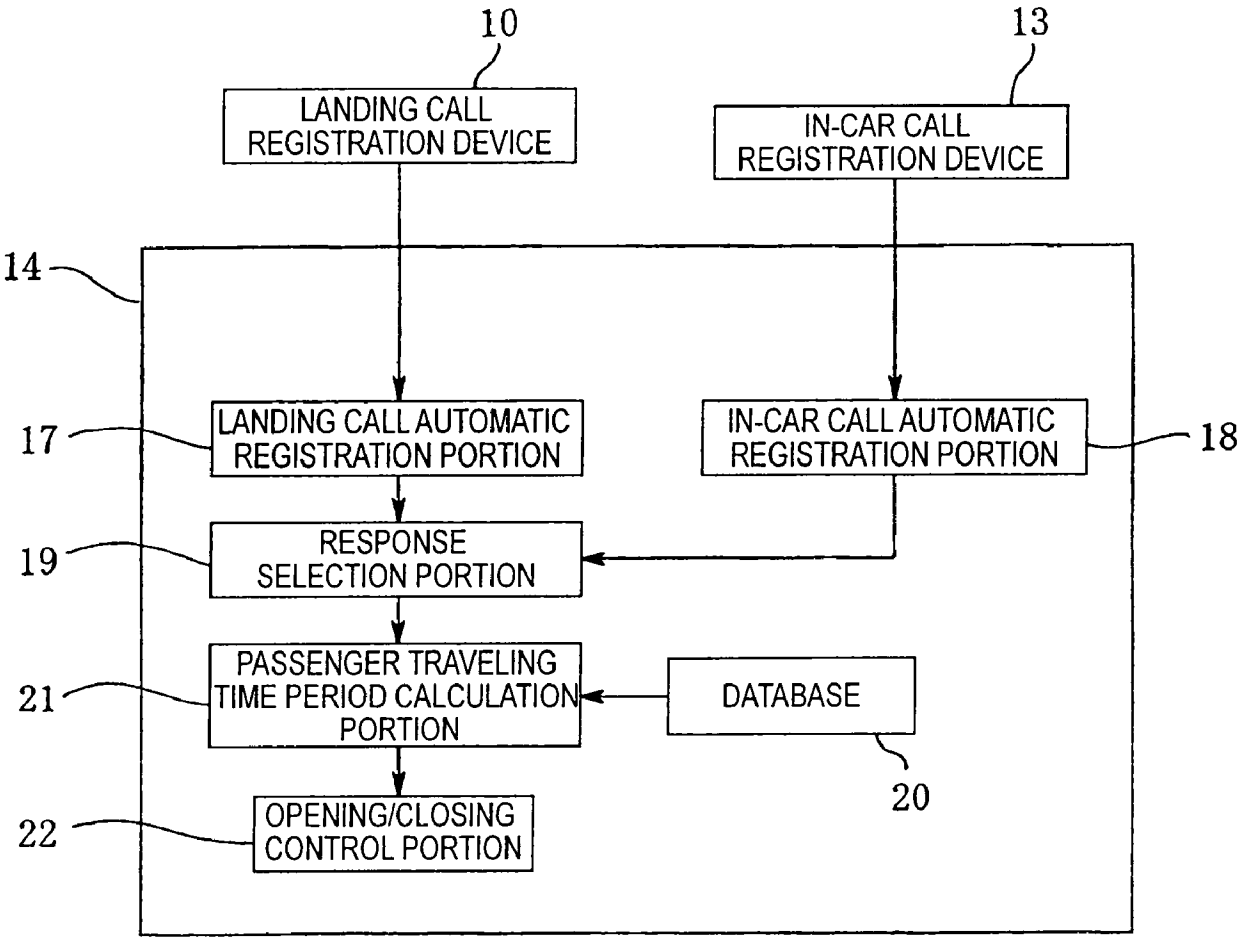
FIG. 2 is a functional block diagram showing the control system for the elevators of FIG. 1.

FIG. 2 is a functional block diagram showing the control system for the elevators of FIG. 1. Referring to FIG. 2, the control system body 14 has a landing call automatic registration portion 17, an in-car call automatic registration portion 18, a response selection portion 19, a database (storage portion) 20, a passenger traveling time period calculation portion 21, and an opening/closing control portion 22.

The landing call automatic registration portion 17 sets as a car call floor that one of the landing floors 4 whose landing call registration device 10 is operated, based on information from landing call registration devices 10, and automatically makes a car call registration for stopping any one of the cars 5 of the elevator apparatuses 1 to 3 at the car call floor.

The in-car call automatic registration portion 18 automatically makes a car call registration for stopping the car 5 at a destination floor selected through the operation of each of in-car call registration devices 13, based on information from the in-car call registration devices 13.

The response selection portion 19 selects as a selected elevator that one of the elevator apparatuses 1 to 3 which responds to a car call registration made by the landing call automatic registration portion 17, based on information from the elevator apparatuses 1 to 3, information from the landing call automatic registration portion 17, and information from the in-car call automatic registration portion 18. That is, the response selection portion 19 calculates as evaluation values waiting time periods at a car call floor which are required until the arrival of the cars 5 of the elevator apparatuses 1 to 3 (performs calculation of the evaluation values), and selects as a selected elevator that one of the elevator apparatuses which has the best evaluation value. That is, the response selection portion 19 performs calculation of the evaluation values of the elevator apparatuses 1 to 3 to select the selected elevator. The selected elevator is selected based on information on the position and the speed of each of the cars 5 of the elevator apparatuses 1 to 3, information on whether or not each of the cars 5 is fully loaded, information on the number of stops of each of the cars 5 before the arrival thereof at the car call floor, and the like. In this example, the selected elevator is selected by the group supervision/control device 15.

Time periods required for the traveling of passengers from the landing call registration device 10 to the elevator doorways 6 (passenger traveling time periods) are stored in the database 20 in advance.

The passenger traveling time period calculation portion 21 sets as a selected doorway that one of the elevator doorways 6 of the selected elevator which is provided at the car call floor, based on information from the response selection portion 19 and information from the database 20, and calculates a passenger traveling time period required for the traveling of a passenger from the landing call registration device 10 to the selected doorway. The passenger traveling time period is calculated by reading from the database 20 that one of the passenger traveling time periods which corresponds to the selected doorway.

The opening/closing control portion 22 controls the opening/closing operation of the selected doorway based on operational information from the selected elevator and information from the passenger traveling time period calculation portion 21. More specifically, when the selected doorway is already in a door-open state at the time of registration of a car call by the landing call automatic registration portion 17, the opening/closing control portion 22 continues to hold the selected doorway in the door-open state until the passenger traveling time period calculated by the passenger traveling time period calculation portion 21 elapses after registration of the car call. That is, when the selected doorway is already in the door-open state at the time of registration of a car call by the landing call automatic registration portion 17, the opening/closing control portion 22 performs control for preventing the door-closing operation of the selected doorway from being started until a passenger who has operated the landing call registration device 10 reaches the selected doorway. When the door-opening operation of the selected doorway is completed after the lapse of the passenger traveling time period, the opening/closing control portion 22 performs, as to the selected doorway, the control of normal opening/closing operation to maintain the door-open state for a normal door-open time period set in advance. The opening/closing operation of the selected doorway is controlled by a corresponding one of the individual control devices 16, based on an opening/closing command from the group supervisory control device 15.

The control system body 14 is constituted by a computer having a central processing unit (CPU), a storage portion (ROM, RAM, and the like), and signal input/output portions. The functions of the landing call automatic registration portion 17, the in-car call automatic registration portion 18, the response selection portion 19, the database 20, the passenger traveling time period calculation portion 21, and the opening/closing control portion 22 are realized by the computer constituting the control system body 14.

That is, programs for realizing the functions of the landing call automatic registration portion 17, the in-car call automatic registration portion 18, the response selection portion 19, the database 20, the passenger traveling time period calculation portion 21, and the opening/closing control portion 22 are stored in the storage portion of the computer. Information on passenger traveling time periods, information on normal door-open time periods, and the like are also stored in the storage portion. The central processing unit performs calculation processings regarding the functions of the control system body 14 based on the programs stored in the storage portion.

Figure 3:
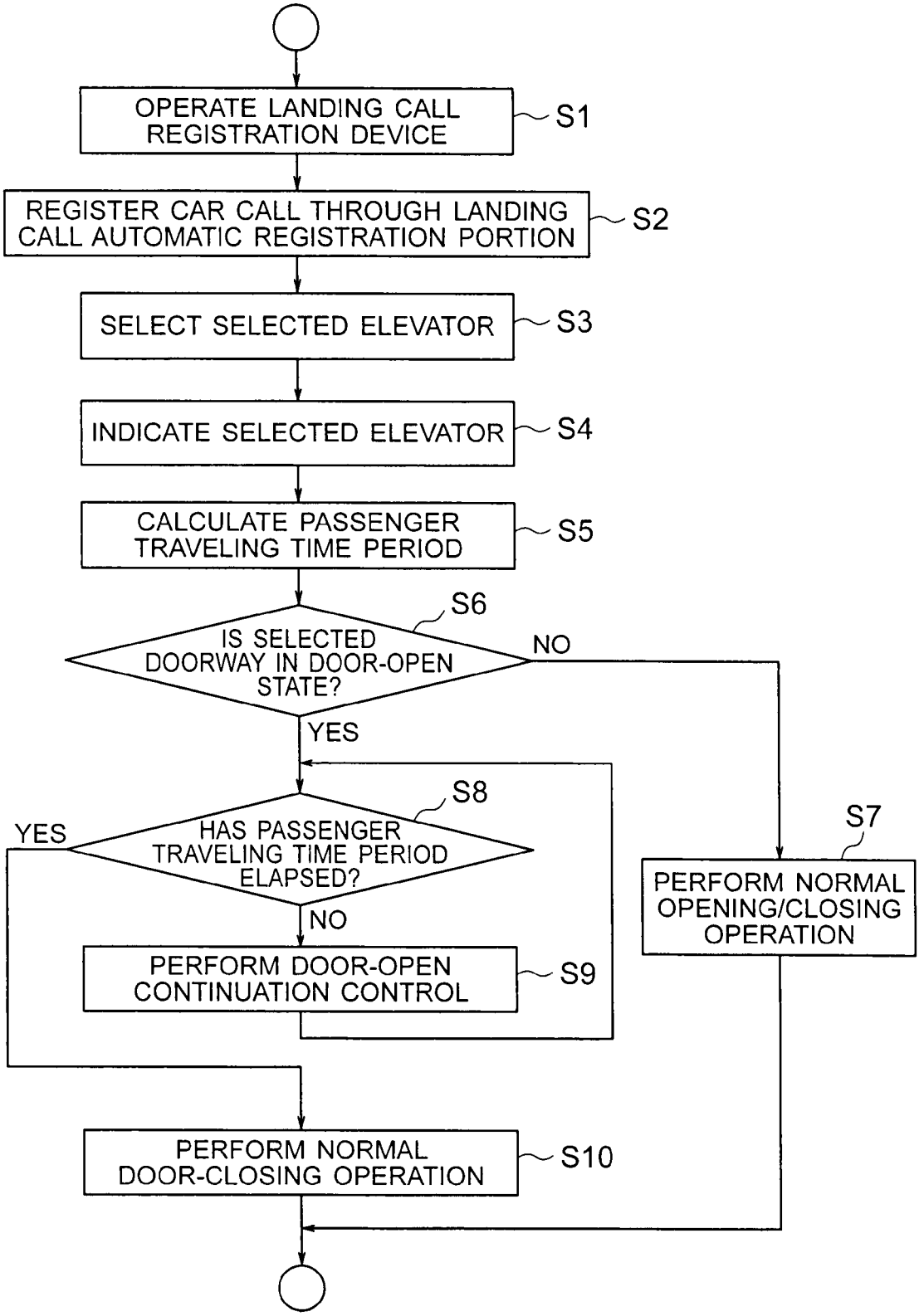
FIG. 3 is a flowchart for explaining processing operations of the control system body of FIG. 2.

Next, an operation thereof will be described. FIG. 3 is a flowchart for explaining processing operations of the control system body 14 of FIG. 2. As shown in FIG. 3, when the landing call registration device 10 is operated (S1), the landing call automatic registration portion 17 makes a car call registration for setting as a car call floor that one of the landing floors 4 where the landing call registration device 10 is installed (S2).

After that, the response selection portion 19 performs calculation of evaluation values of the elevator apparatuses 1 to 3 based on operational information on the elevator apparatuses 1 to 3, information on a car call floor registered by the landing call automatic registration portion 17, and information on a destination floor registered by the in-car call automatic registration portion 18. As a result, that one of the elevator apparatuses 1 to 3 which responds to the car call registration made by the landing call automatic registration portion 17 is selected as the selected elevator (S3). After that, the indicator 12 of the landing call registration device 10 indicates the selected elevator based on information from the response selection portion 19 (S4).

After that, the passenger traveling time period calculation portion 21 calculates a time period required for the traveling of a passenger from the landing call registration device 10 to a selected doorway (the elevator doorway 6 of the selected elevator). The passenger traveling time period is calculated by reading that one of the passenger traveling time periods stored in the database 20 in advance so as to correspond to the elevator doorways 6 which corresponds to the selected doorway (S5).

After that, the control system body 14 determines whether or not the selected doorway is in a door-open state, based on operational information on the selected elevator (S6). When it is determined that the selected doorway is not in the door-open state, the opening/closing control portion 22 carries out control to perform the normal opening/closing operation of the selected doorway, thereby terminating the processings (S7).

When it is determined that the selected doorway is in the door-open state, it is determined whether or not a time period elapsed after registration of a car call by the landing call automatic registration portion 17 is longer than the passenger traveling time period calculated by the passenger traveling time period calculation portion 21 (S8).

When it is determined that the passenger traveling time period has not elapsed, the opening/closing control portion 22 performs control to hold the selected doorway in the door-open state until the passenger traveling time period elapses (S9).

When it is determined that the passenger traveling time period has elapsed, the opening/closing control portion 22 performs control to perform a door-closing operation after the lapse of a normal door-open time period, thereby terminating the processing (S10).

In the control system for the elevators configured as described above, when the selected doorway is already in the door-open state at the time of registration of a car call by the landing call automatic registration portion 17, the door-open state of the selected doorway continues to be held until a passenger traveling time period elapses after registration of the car call. Therefore, the door of each of the elevator doorways 6 can be prevented from being closed before passengers reach that elevator doorway 6, so the passengers can be prevented from missing a corresponding one of the cars 5. The selected elevator is selected from all the elevator apparatuses 1 to 3. Therefore, the selected elevator can be selected efficiently, so the waiting time period of each passenger can be shortened.

In the foregoing example, the single passenger traveling time period is stored in the database 20 as to each of the elevator doorways 6. However, a passenger traveling time period for the able-bodied persons and a passenger traveling time period for the disabled persons may be stored separately as to each of the elevator doorways 6. In this case, the passenger traveling time period calculation portion 21 calculates a passenger traveling time period by reading the passenger traveling time period for the able-bodied persons from the database 20 when a car call registration is made through the operation of a selector for the able-bodied persons, and by reading the passenger traveling time period for the disabled persons from the database 20 when a car call registration is made through the operation of a selector for the disabled persons. In this manner, even a disabled passenger can be prevented from missing each of the cars 5.

Embodiment 2

In each of the foregoing examples, the passenger traveling time period corresponding to each of the elevator doorways 6 does not differ depending on the degree of crowdedness of a car call floor. However, the passenger traveling time period may differ depending on the degree of crowdedness of the car call floor.

That is, time zone information including information on a peak time zone in which the landing floors 4 are crowded with passengers and information on an off-peak time zone in which the landing floors 4 are uncrowded, and passenger traveling time period information including information on passenger traveling time periods corresponding to the peak time zone and information on passenger traveling time periods corresponding to the off-peak time zone are stored in the database 20. The passenger traveling time periods included in the passenger traveling time period information are set so as to correspond to each of the elevator doorways 6.

The passenger traveling time period calculation portion 21 selects either the passenger traveling time periods within the peak time zone or the passenger traveling time periods in the off-peak time zone based on information at the time of the making of a car call registration by the landing call automatic registration portion 17, and reads that one of the selected passenger traveling time periods which corresponds to a selected elevator. In this manner, the passenger traveling time period calculation portion 21 calculates the passenger traveling time period. Embodiment 2 of the present invention is identical to Embodiment 1 of the present invention in other configurational details.

Next, an operation thereof will be described. Processing operations in Embodiment 2 of the present invention are the same as in Embodiment 1 of the present invention except the processing operations in calculating the passenger traveling time period. Therefore, only the processing operations in calculating the passenger traveling time period will be described.

Figure 4:
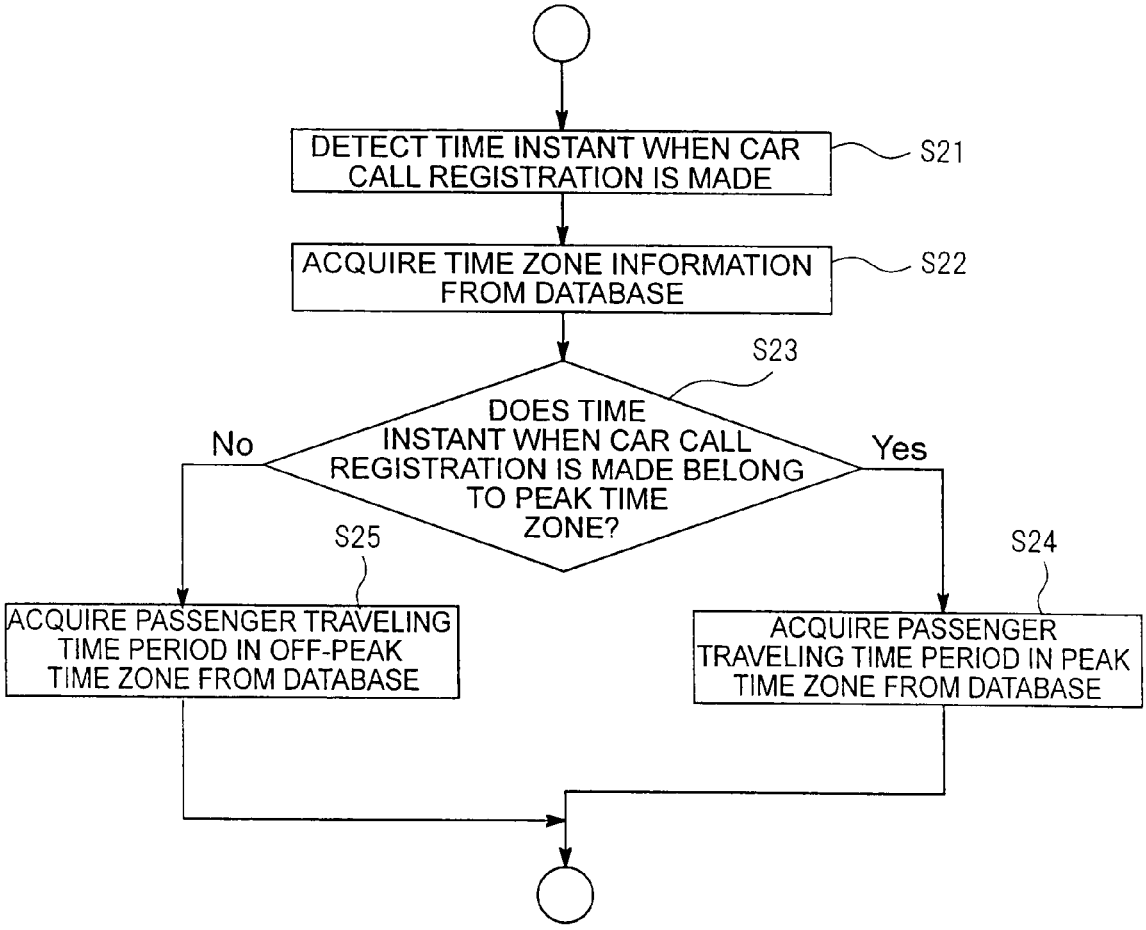
FIG. 4 is a flowchart for explaining the processing operations in calculating the passenger traveling time period in a control system for elevators according to Embodiment 2 of the present invention.

FIG. 4 is a flowchart for explaining the processing operations in calculating the passenger traveling time period in a control system for elevators according to Embodiment 2 of the present invention. As shown in FIG. 4, after detecting a time instant when the landing call automatic registration portion 17 makes a car call registration (S21), the passenger traveling time period calculation portion 21 reads the time zone information from the database 20 (S22).

After that, the passenger traveling time period calculation portion 21 compares the time instant detected thereby with the time zone information. Thus, the passenger traveling time period calculation portion 21 determines whether or not the time instant when the landing call automatic registration portion 17 makes the car call registration is within the peak time zone (S23).

When it is determined that the time instant when the car call registration is made is within the peak time zone, the passenger traveling time period calculation portion 21 reads from the database 20 that one of the passenger traveling time periods which corresponds to the peak time zone and a selected doorway (S24) In this manner, the passenger traveling time period is calculated.

When it is determined that the time instant when the car call registration is made is not within the peak time zone, the passenger traveling time period calculation portion 21 reads from the database 20 that one of the passenger traveling time periods which corresponds to the off-peak time zone and the selected doorway (S25). In this manner, the passenger traveling time period is calculated. The subsequent operations are the same as in Embodiment 1 of the present invention.

In the control system for the elevators configured as described above, the passenger traveling time periods within the peak time zone and the off-peak time zone are set in the database 20 in advance, and it is determined to which one of the time zones the time instant when the landing call automatic registration portion 17 makes the car call registration belongs, so the passenger traveling time period corresponding to the degree of crowdedness of the car call floor with passengers is calculated. Therefore, the passenger traveling time period at the car call floor can be calculated more reliably with a simple configuration, so the passengers can further be prevented from missing the cars 5.

Embodiment 3

In the foregoing example, a determination on the degree of crowdedness at the car call floor is made according to each of the time zones. However, the determination on the degree of crowdedness at the car call floor may be made according to the number of car call registrations made by the landing call automatic registration portion 17.

That is, in Embodiment 3 of the present invention, the passenger traveling time period calculation portion 21 detects the number of car call registrations made by the landing call automatic registration portion 17 per unit time (e.g., per minute), and determines, based on the detected number of the car call registrations, whether or not the car call floor is crowded. That is, when the number of the car call registrations made by the landing call automatic registration portion 17 per unit time is larger than a preset reference number, the passenger traveling time period calculation portion 21 determines that the car call floor is crowded. When the number of the car call registrations is equal to or smaller than the reference number, the passenger traveling time period calculation portion 21 determines that the car call floor is uncrowded.

Passenger traveling time periods in a crowded state and passenger traveling time periods in an uncrowded state are stored in the database 20 in advance so as to correspond to the elevator doorways 6. The passenger traveling time period calculation portion 21 selects, based on a result of the determination made on the crowdedness of the car call floor, either the passenger traveling time periods in the crowded state or the passenger traveling time periods in the uncrowded state, and reads that one of the selected passenger traveling time periods which corresponds to a selected elevator. In this manner, the passenger traveling time period calculation portion 21 calculates the passenger traveling time period. Embodiment 3 of the present invention is identical to Embodiment 1 of the present invention in other configurational details.

Next, an operation thereof will be described. Processing operations in Embodiment 3 of the present invention are the same as in Embodiment 1 of the present invention except the processing operations in calculating the passenger traveling time period. Therefore, only the processing operations in calculating the passenger traveling time period will be described.

Figure 5:
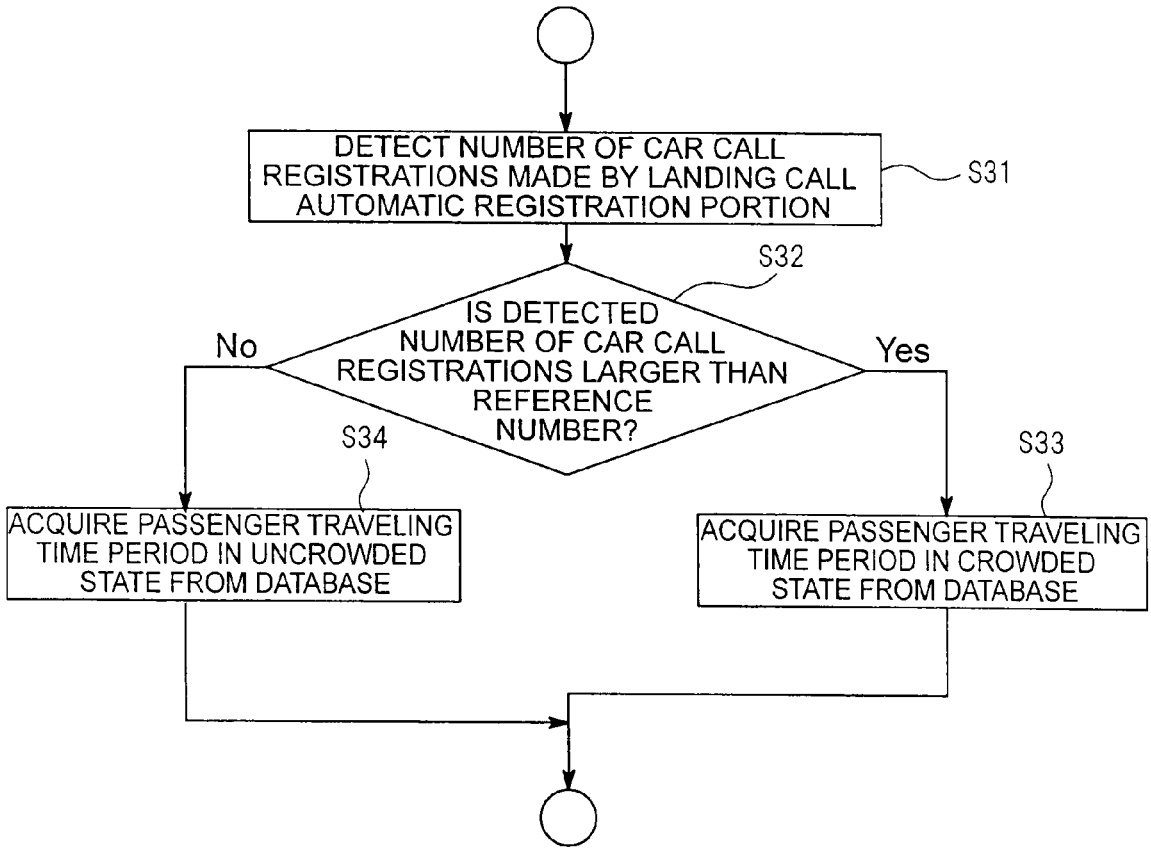
FIG. 5 is a flowchart for explaining the processing operations in calculating the passenger traveling time period in a control system for elevators according to Embodiment 3 of the present invention.

FIG. 5 is a flowchart for explaining the processing operations in calculating the passenger traveling time period in a control system for elevators according to Embodiment 3 of the present invention. As shown in FIG. 5, in calculating the passenger traveling time period, the passenger traveling time period calculation portion 21 detects the number of car call registrations made by the landing call automatic registration portion 17 per unit time (S31). After that, the passenger traveling time period calculation portion 21 determines whether or not the detected number of the car call registrations is larger than a reference number (S32).

When the number of the car call registrations is larger than the reference number, the car call floor is considered to be crowded, so the passenger traveling time period calculation portion 21 reads the passenger traveling time periods in the crowded state from the database 20 (S33).

When the number of the car call registrations is equal to or smaller than the reference number, the car call floor is considered to be uncrowded, so the passenger traveling time period calculation portion 21 reads the passenger traveling time periods in the uncrowded state from the database 20 (S34).

In this manner, after the passenger traveling time period corresponding to the selected doorway has been calculated, the processing operations are performed in the same manner as in Embodiment 1 of the present invention.

As described above, the passenger traveling time period calculation portion 21 determines, based on the number of the car call registrations made by the landing call automatic registration portion 17, whether or not the car call floor is crowded, and calculates the passenger traveling time period based on the result of the determination. Therefore, even in the case where the number of passengers increases temporarily, for example, when a group of visitors use the elevators, the passenger traveling time period at the car call floor can be calculated more reliably with a simple configuration, so the passengers can further be prevented from missing the cars 5.

Embodiment 4

In each of the foregoing examples, the response selection portion 19 selects that one of the elevator apparatuses which has the best evaluation value obtained through evaluation value calculation, immediately as the selected elevator. However, the response selection portion 19 may temporarily select a candidate elevator as a candidate for the selected elevator based on evaluation value calculation, and determine based on an additional condition whether or not the candidate elevator can be selected as the selected elevator.

Figure 6:
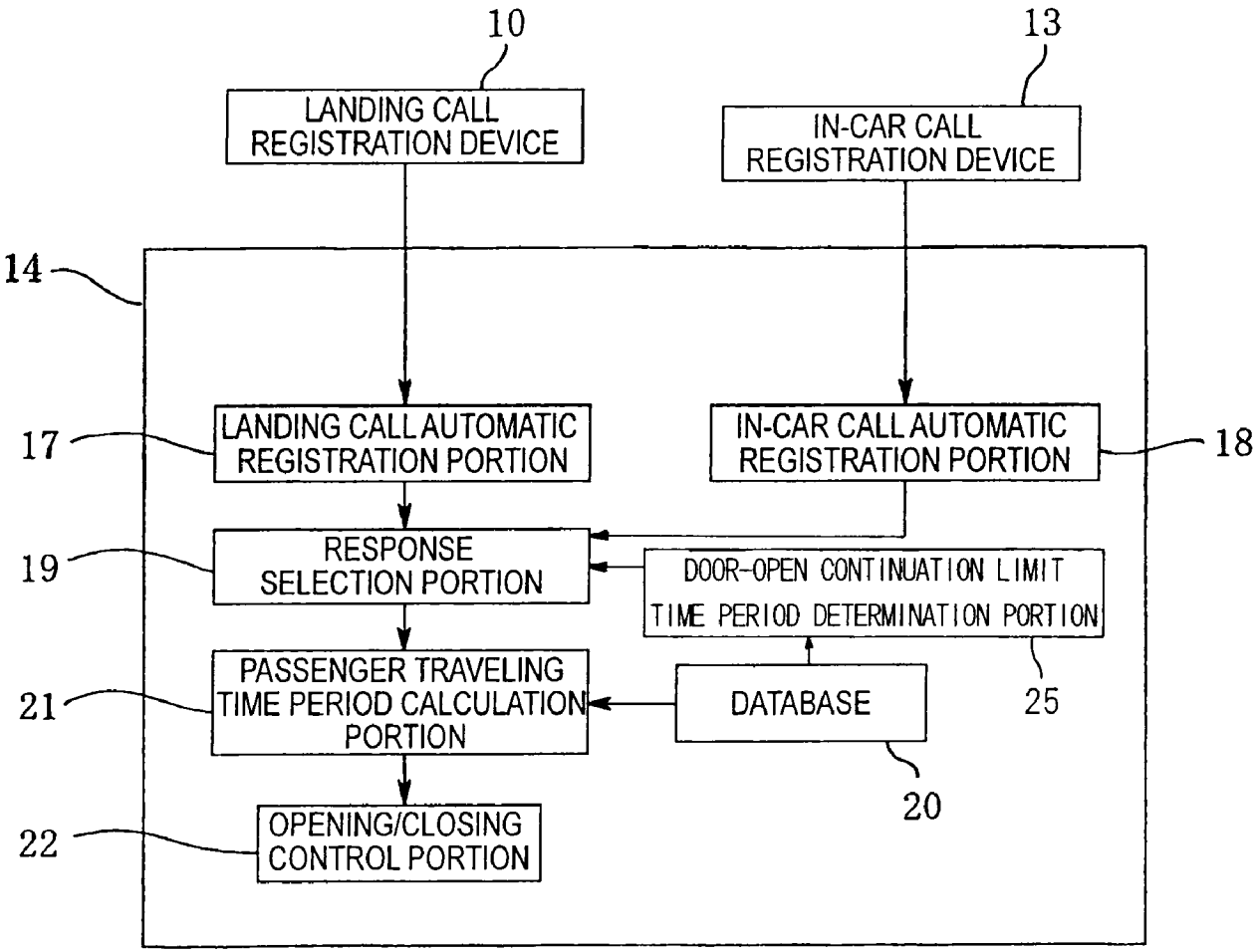
FIG. 6 is a functional block diagram showing a control system for elevators according to Embodiment 4 of the present invention.

That is, FIG. 6 is a functional block diagram showing a control system for elevators according to Embodiment 4 of the present invention. Referring to FIG. 6, the control system body 14 has the landing call automatic registration portion 17, the in-car call automatic registration portion 18, the response selection portion 19, the database (storage portion) 20, the passenger traveling time period calculation portion 21, the opening/closing control portion 22, and a door-open continuation limit time period determination portion 25.

The response selection portion 19 performs evaluation value calculation as to the elevator apparatuses 1 to 3 to temporarily select a candidate elevator as a candidate for a selected elevator.

Passenger traveling time periods and limit (longest) time periods for continuation of a door-open state (door-open continuation limit time periods) are stored in advance in the database 20 so as to correspond to each of the elevator doorways 6.

The passenger traveling time period calculation portion 21 sets that one of the elevator doorways 6 of the candidate elevator which is provided at a car call floor as a candidate doorway, based on information from the response selection portion 19 and information from the database 20, and calculates a passenger traveling time period required for the traveling of a passenger from the landing call registration device 10 to the candidate doorway. The passenger traveling time period is calculated by reading that one of the passenger traveling time periods which corresponds to the candidate doorway from the database 20.

The door-open continuation limit time period determination portion 25 sets that one of the elevator doorways 6 of the candidate elevator which is provided at a car call floor as a candidate doorway, based on information from the response selection portion 19 and information from the database 20, and calculates a door-open continuation limit time period as to the candidate doorway. The door-open continuation limit time period is calculated by reading that one of the door-open continuation limit time periods which corresponds to the candidate doorway from the database 20.

During the opening/closing operation of each of the elevator doorways 6, the control system body 14 counts a time period elapsed after the establishment of a door-open state, as to that elevator doorway 6. The response selection portion 19 calculates a time period from a moment when the candidate doorway assumes the door-open state to a moment when the landing call automatic registration portion 17 registers a car call as a door-open continuation elapsed time period, based on the time period counted by the control system body 14, and adds a passenger traveling time period calculated by the passenger traveling time period calculation portion 21 to the calculated door-open continuation elapsed time period, to thereby calculating a door-open continuation scheduled time period. The door-open continuation scheduled time period is a scheduled time period during which the candidate doorway continues to be held in the door-open state.

The response selection portion 19 compares the door-open continuation scheduled time period calculated based on information from the passenger traveling time period calculation portion 21 with the door-open continuation limit time period acquired based on information from the door-open continuation limit time period determination portion 25 to determine whether or not a candidate elevator can be selected as a selected elevator. That is, the response selection portion 19 excludes the candidate elevator from candidates for the selected elevator when the door-open continuation scheduled time period is longer than the door-open continuation limit time period as to the candidate doorway, and selects the candidate elevator as the selected elevator when the door-open continuation scheduled time period is equal to or shorter than the door-open continuation limit time period as to the candidate doorway. After having excluded the candidate elevator from the candidates for the selected elevator, the response selection portion 19 selects a new candidate elevator from those of the elevator apparatuses which are other than the excluded candidate elevator. Embodiment 4 of the present invention is identical to Embodiment 1 of the present invention in other configurational details.

Figure 7:
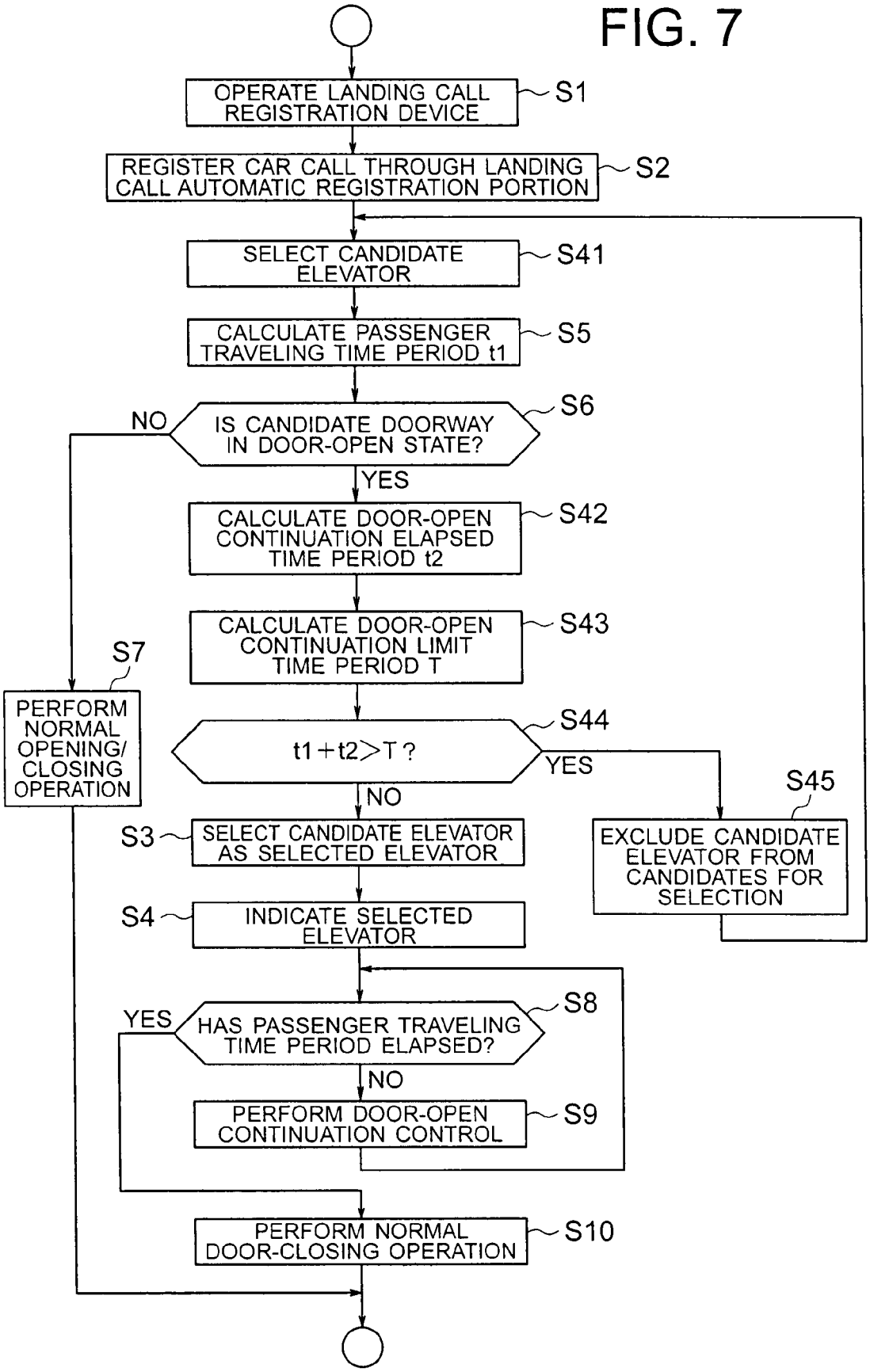
FIG. 7 is a flowchart for explaining the processing operations of the control system body of FIG. 6.

Next, the processing operations of the control system body 14 will be described. FIG. 7 is a flowchart for explaining the processing operations of the control system body 14 of FIG. 6. As shown in FIG. 7, when the landing call registration device 10 is operated (S1), the landing call automatic registration portion 17 registers a car call to set that one of the landing floors 4 at which the landing call registration device 10 is installed as a car call floor (S2).

After that, the response selection portion 19 performs evaluation value calculation as to the elevator apparatuses 1 to 3, based on operational information on the elevator apparatuses 1 to 3, information on the car call floor registered by the landing call automatic registration portion 17, and information on a destination floor registered by the in-car call automatic registration portion 18. Thus, a candidate elevator as a candidate for a selected elevator is selected from the elevator apparatuses 1 to 3 (S41).

After that, the passenger traveling time period calculation portion 21 calculates a passenger traveling time period t1 for the traveling from the landing call registration device 10 to a candidate doorway (S5). After that, the control system body 14 determines whether or not the candidate doorway is already in a door-open state (S6). When it is determined that the candidate doorway is not in the door-open state, the opening/closing control portion 22 carries out control to perform the normal opening/closing operation of the candidate doorway, thereby terminating the processings (S7).

When it is determined that the candidate doorway is already in the door-open state, the response selection portion 19 calculates a door-open continuation elapsed time period t2 as to the candidate doorway (S42). After that, the door-open continuation limit time period determination portion 25 calculates a door-open continuation limit time period T as to the candidate doorway (S43).

After that, the response selection portion 19 determines whether or not a door-open continuation scheduled time period (t1+t2), which is obtained by adding the passenger traveling time period t1 to the door-open continuation elapsed time period t2, is longer than the door-open continuation limit time period T (S44).

When it is determined that the door-open continuation scheduled time period (t1+t2) is longer than the door-open continuation limit time period T, the response selection portion 19 excludes the candidate elevator from candidates for the selected elevator (S45). After that, the response selection portion 19 selects a new candidate elevator other than the excluded candidate elevator (S41), and performs the same processings as described above.

When it is determined that the door-open continuation scheduled time period (t1+t2) is equal to or shorter than the door-open continuation limit time period T, the response selection portion 19 selects the candidate elevator as the selected elevator (S3). After that, the indicator 12 of the landing call registration device 10 indicates the selected elevator according to information from the response selection portion 19 (S4). After that, it is determined whether or not the time period elapsed after registration of the car call by the landing call automatic registration portion 17 is longer than the passenger traveling time period t1 calculated by the passenger traveling time period calculation portion 21 (S8). The subsequent processing operations are the same as in Embodiment 1 of the present invention.

In the control system for the elevators configured as described above, the candidate elevator as the candidate for the selected elevator is temporarily selected, and the door-open continuation scheduled time period is compared with the door-open continuation limit time period as to the candidate doorway, when the candidate doorway is already in the door-open state at the time of registration of a car call by the landing call automatic registration portion 17. It is thereby determined whether or not the candidate elevator can be selected as the selected elevator. Therefore, the time period for continuation of the door-open state of each of the elevator doorways 6 can be prevented from becoming extremely long, so the efficiency in running the elevators can be prevented from deteriorating.

Embodiment 5

In the foregoing example, the door-open continuation limit time period T corresponding to each of the elevator doorways 6 does not differ depending on the degree of crowdedness at the car call floor. However, the door-open continuation limit time period may differ depending on the degree of crowdedness at the car call floor.

That is, time zone information including information on a peak time zone in which the landing floors 4 are crowded with passengers and information on an off-peak time zone in which the landing floors 4 are uncrowded, and limit time period information including information on door-open continuation limit time periods corresponding to the peak time zone and information on door-open continuation limit time periods corresponding to the off-peak time zone are stored in the database 20. The door-open continuation limit time periods included in the limit time period information are set so as to correspond to each of the elevator doorways 6.

The door-open continuation limit time period determination portion 25 selects the passenger traveling time periods within the peak time zone or the passenger traveling time periods in the off-peak time zone based on information at the time of registration of a car call by the landing call automatic registration portion 17, and reads the door-open continuation limit time period corresponding to the candidate doorway from the selected passenger traveling time periods. In this manner, the door-open continuation limit time period determination portion 25 calculates the door-open continuation limit time period. Embodiment 5 of the present invention is identical to Embodiment 4 of the present invention in other configurational details.

Next, operations will be described. The processing operations in Embodiment 5 of the present invention are identical to the processing operations in Embodiment 4 of the present invention except in the processing operation in calculating the door-open continuation limit time period. Therefore, only the processing operation in calculating the door-open continuation limit time period will be described.

Figure 8:
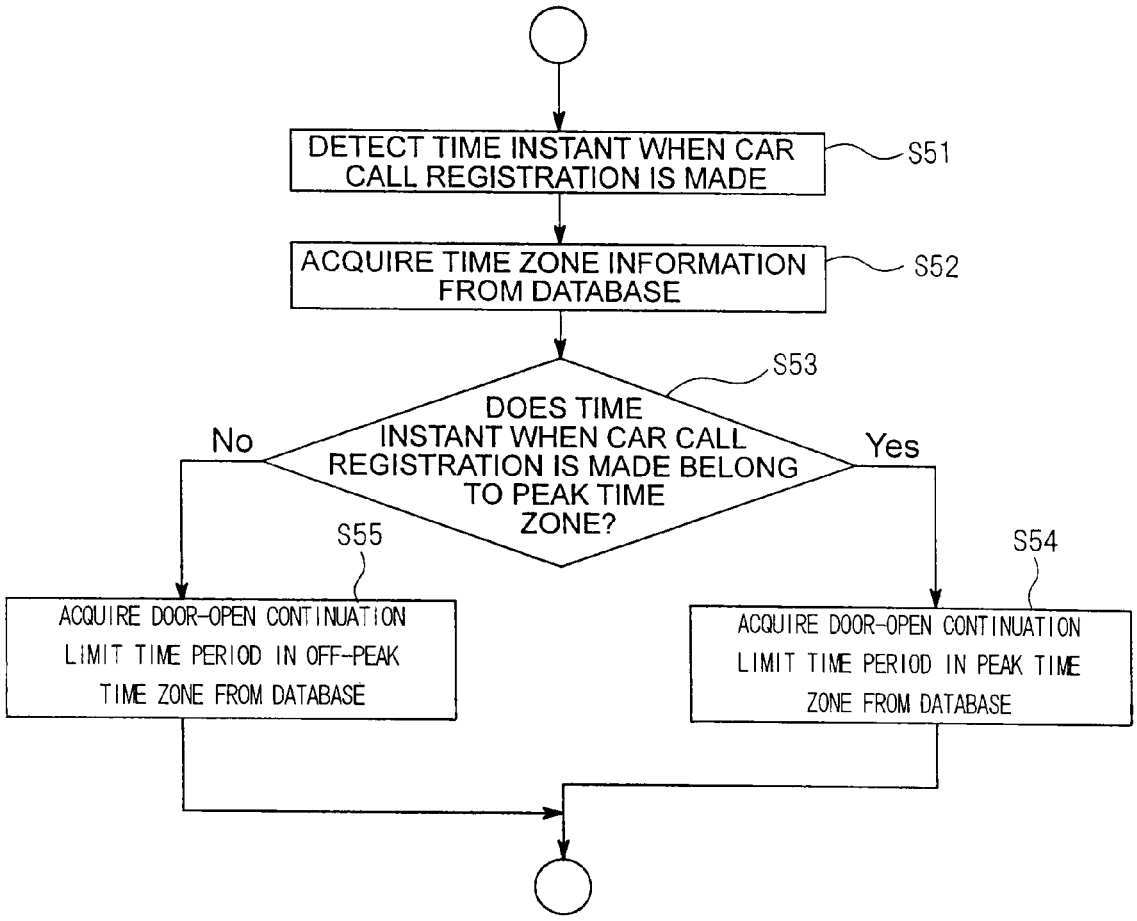
FIG. 8 is a flowchart for explaining the processing operation in calculating the door-open continuation limit time period in the control system for the elevators according to Embodiment 5 of the present invention.

FIG. 8 is a flowchart for explaining the processing operation in calculating the door-open continuation limit time period in the control system for the elevators according to Embodiment 5 of the present invention. As shown in FIG. 8, after detection of a time instant when the landing call automatic registration portion 17 makes a car call registration by the door-open continuation limit time period determination portion 25 (S51), the door-open continuation limit time period determination portion 25 reads the time zone information from the database 20 (S52).

After that, the door-open continuation limit time period determination portion 25 compares the time instant detected thereby with the time zone information. Thus, the door-open continuation limit time period determination portion 25 determines whether or not the time instant when the landing call automatic registration portion 17 makes the car call registration is within the peak time zone (S53).

When it is determined that the time instant when the car call registration is made is within the peak time zone, the door-open continuation limit time period determination portion 25 reads the door-open continuation limit time period corresponding to the peak time zone and the candidate doorway from the database (S54). In this manner, the door-open continuation limit time period is calculated.

When it is determined that the time instant when the car call registration is made is not within the peak time zone, the door-open continuation limit time period determination portion reads the door-open continuation limit time period corresponding to the off-peak time zone and the candidate doorway from the database 20 (S55). In this manner, the door-open continuation limit time period is calculated. The subsequent operations are the same as in Embodiment 4 of the present invention.

In the control system for the elevators configured as described above, the door-open continuation limit time periods within the peak time zone and the door-open continuation limit time periods in the off-peak time zone are set in advance in the database 20, and it is determined to which one of the time zones the time instant when the car call registration is made by the landing call automatic registration portion 17 belongs so as to calculate that one of the door-open continuation limit time periods which corresponds to the degree of crowdedness of the car call floor with passengers. Therefore, the door-open continuation limit time period as to the candidate doorway can be calculated more reliably with a simple configuration, so passengers can further be prevented from missing the cars 5.

Embodiment 6

In Embodiment 5 of the present invention, the determination on the degree of crowdedness at the car call floor is made according to the time zone. However, the determination on the degree of crowdedness at the car call floor may be made according to the number of car calls registered by the landing call automatic registration portion 17.

That is, in Embodiment 6 of the present invention, the door-open continuation limit time period determination portion 25 detects the number of car calls registered by the landing call automatic registration portion 17 per unit time (e.g., per minute), and determines based on the detected number of the registered car calls whether or not the car call floor is crowded. That is, the door-open continuation limit time period determination portion 25 determines that the car call floor is crowded when the number of the car call registration made by the landing call automatic registration portion 17 per unit time is larger than a reference number set in advance, and determines that the car call floor is uncrowded when the number of the car calls is equal to or smaller than the reference number.

The door-open continuation limit time periods in the crowded state and the door-open continuation limit time periods in the uncrowded state are stored in advance in the database 20 so as to correspond to each of the elevator doorways 6. The door-open continuation limit time period determination portion 25 selects the door-open continuation limit time periods in the crowded state or the door-open continuation limit time periods in the uncrowded state based on a result of a determination as to whether or not the car call floor is crowded, and reads that one of the selected door-open continuation limit time periods which corresponds to the candidate doorway. In this manner, the door-open continuation limit time period determination portion 25 calculates the door-open continuation limit time period. Embodiment 6 of the present invention is identical to Embodiment 4 of the present invention in other configurational details.

Next, operations will be described. The processing operations in Embodiment 6 of the present invention are identical to the processing operations in Embodiment 4 of the present invention except in the processing operation in calculating the passenger traveling time period. Therefore, only the processing operation in calculating the passenger traveling time period will be described.

Figure 9:
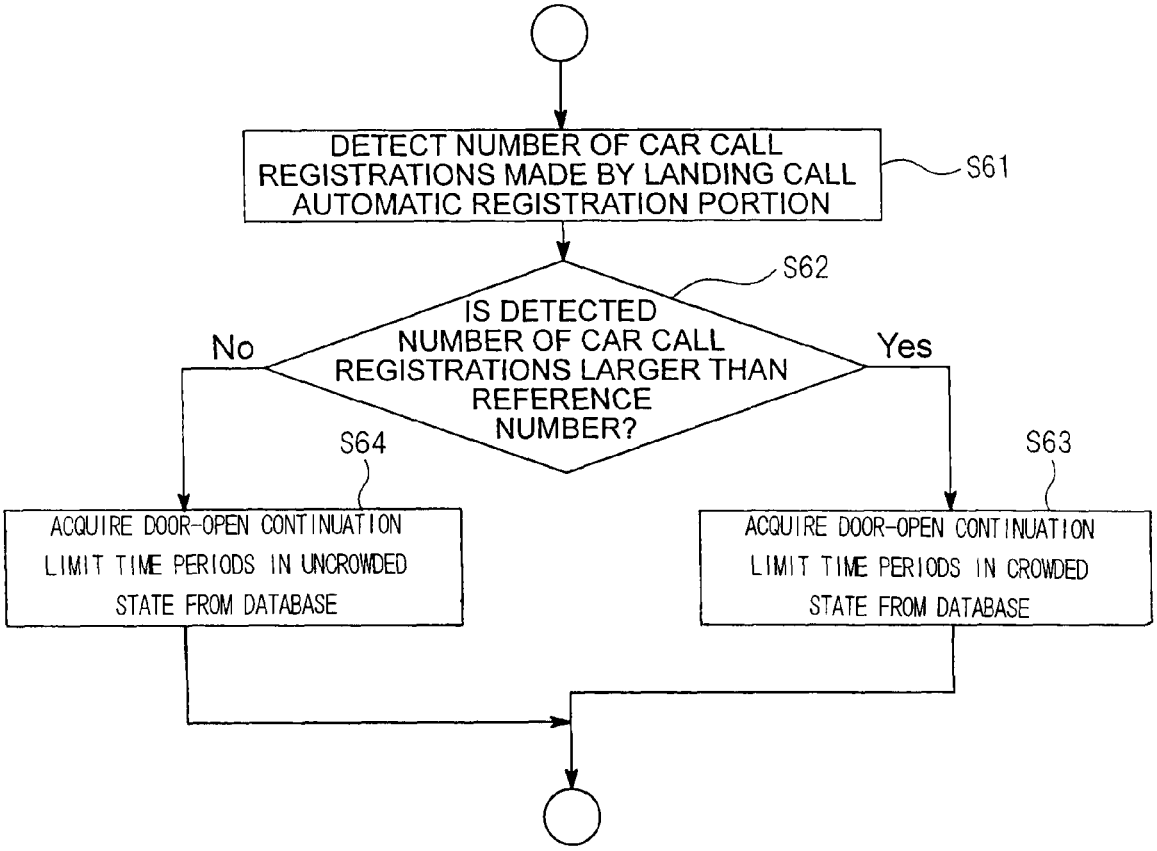
FIG. 9 is a flowchart for explaining the processing operation in calculating a door-open continuation limit time period in the control system for the elevators according to Embodiment 6 of the present invention.

FIG. 9 is a flowchart for explaining the processing operation in calculating a door-open continuation limit time period in the control system for the elevators according to Embodiment 6 of the present invention. As shown in FIG. 9, in calculating the door-open continuation limit time period, the door-open continuation limit time period determination portion 25 detects the number of car calls registered by the landing call automatic registration portion 17 per unit time (S61). After that, the door-open continuation limit time period determination portion 25 determines whether or not the detected number of the registered car calls is larger than a reference number (S62).

When the number of the registered car calls is larger than the reference number, the car call floor is considered to be crowded, so the door-open continuation limit time period determination portion 25 reads the door-open continuation limit time periods in the crowded state from the database 20 (S63).

When the number of the registered car calls is equal to or smaller than the reference number, the car call floor is considered to be uncrowded, so the door-open continuation limit time period determination portion 25 reads the door-open continuation limit time periods in the uncrowded state from the database 20 (S64).

In this manner, after that one of the door-open continuation limit time periods which corresponds to the candidate doorway has been calculated, the processing operations are performed in the same manner as in Embodiment 2 of the present invention.

As described above, the door-open continuation limit time period determination portion 25 determines, based on the number of the car calls registered by the landing call automatic registration portion 17, whether or not the car call floor is crowded, and calculates the door-open continuation limit time period based on a result of the determination. Therefore, even when the number of passengers temporarily increases, for example, when a group of visitors use the elevators, the door-open continuation limit time period as to the candidate doorway can be calculated more reliably. As a result, the passengers can further be prevented from missing the cars 5.

In the foregoing example, the door-open continuation limit time period determination portion 25 reads the information on the door-open continuation limit time period, which is other than the passenger traveling time period, from the database 20 to calculate the door-open continuation limit time period. However, it is also appropriate that only the passenger traveling time periods be stored in the database 20, and that the door-open continuation limit time period determination portion 25 calculate the door-open continuation limit time period based on information on the passenger traveling time period read from the database 20. That is, the door-open continuation limit time period may be calculated as a function of the passenger traveling time period. In this case, the door-open continuation limit time period changes according to the passenger traveling time period.

Embodiment 7

Figure 10:
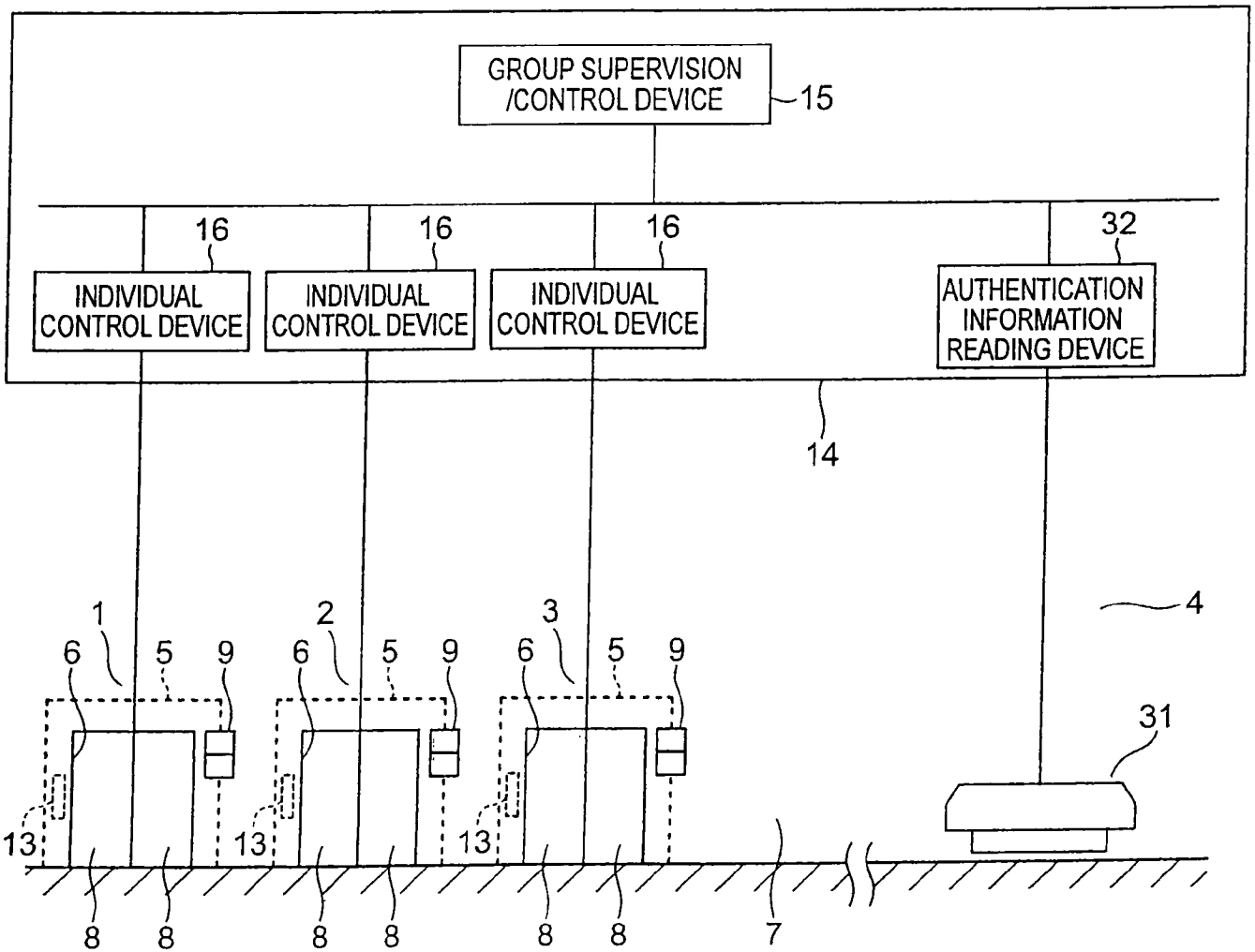
FIG. 10 is a schematic diagram showing a control system for elevators according to Embodiment 7 of the present invention.
Figure 11:
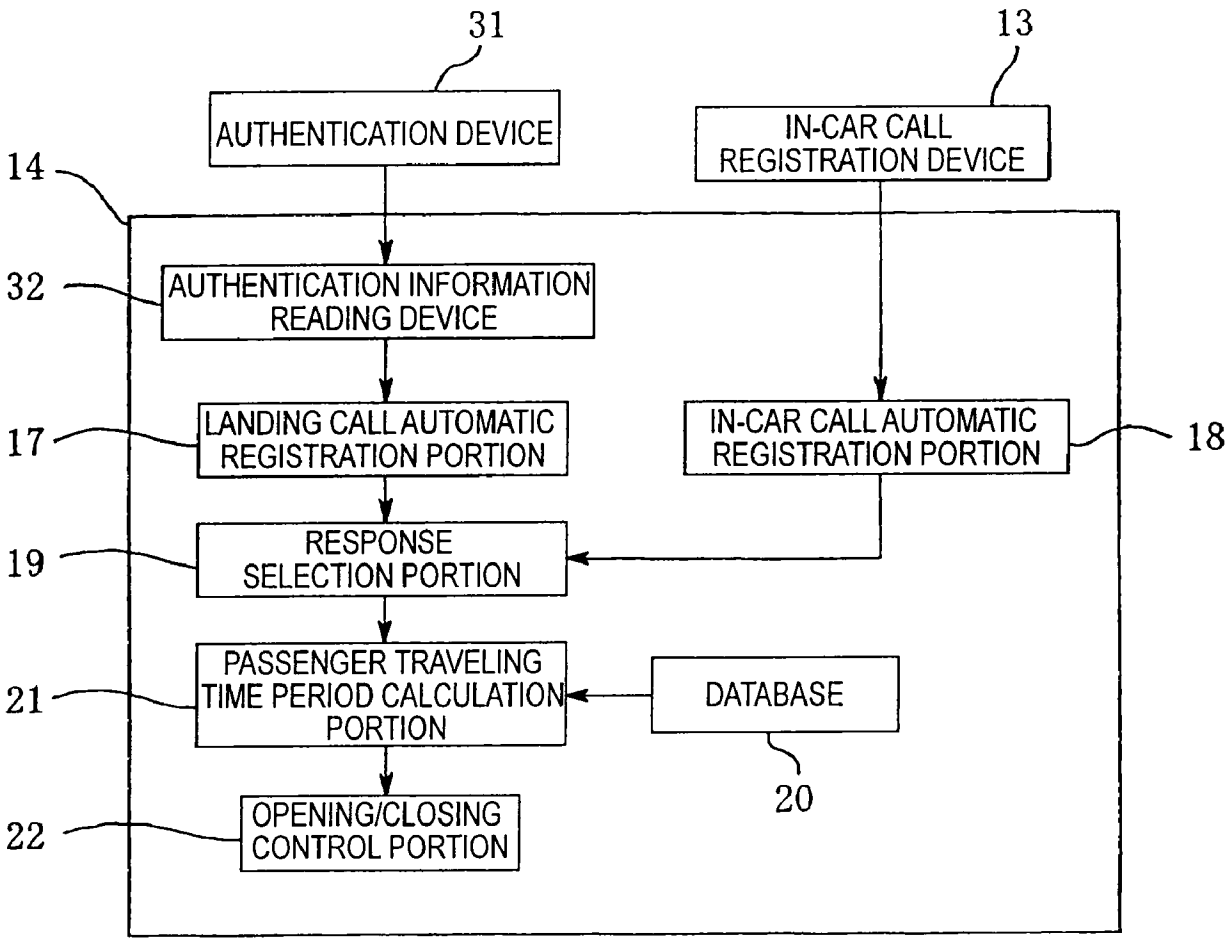
FIG. 11 is a functional block diagram showing the control system for the elevators shown in FIG. 10.

FIG. 10 is a schematic diagram showing a control system for elevators according to Embodiment 7 of the present invention. FIG. 11 is a functional block diagram showing the control system for the elevators shown in FIG. 10. Referring to FIGS. 10 and 11, an authentication device 31, which can acquire personal information on passengers stored in, for example, contact-type magnetic cards, non-contact-type IC cards, or non-contact tag components so as to authenticate individuals based on the acquired personal information, is installed at each of the landing floors 4 as a landing call registration device.

The hall doorway of the elevator hall 7 is provided with a security gate for allowing a passenger to enter the elevator hall 7 only when the personal information on the passenger is authenticated by the authentication device 31. The hall doorway may be provided with a door that is usually locked but temporarily unlocked through an authentication made by the authentication device 31. Alternatively, the hall doorway may be provided with a door that automatically opens the hall doorway only when an authentication is made by the authentication device 31.

The control system body 14 further has an authentication information reading device 32 for analyzing personal information acquired by the authentication device 31. The personal information contains detailed information on, for example, passenger traveling time periods corresponding to the elevator doorways 6, target floors, and car call floor. The authentication information reading device 32 analyzes the personal information to detect the above-mentioned detailed information.

Information from the authentication information reading device 32 is transmitted to the landing call automatic registration portion 17. The landing call automatic registration portion 17 makes a car call registration only when a passenger is authenticated by the authentication device 31.

The passenger traveling time period calculation portion 21 calculates a passenger traveling time period corresponding to the personal information authenticated by the authentication device 31, based on the information from the authentication information reading device 32. That is, the passenger traveling time period calculation portion 21 reads the information on the passenger traveling time periods from the detailed information analyzed by the authentication information reading device 32, thereby calculating a passenger traveling time period corresponding to the personal information. Embodiment 7 of the present invention is identical to Embodiment 1 of the present invention in other configurational details.

In the control system for the elevators configured as described above, the landing call automatic registration portion 17 makes a car call registration only when a passenger is authenticated by the authentication device 31. Therefore, a car call registration can be prevented from being made by an outsider, so an improvement in security effect can be achieved.

The passenger traveling time period calculation portion 21 calculates the passenger traveling time period corresponding to the personal information authenticated by the authentication device 31, so the passenger traveling time period can be set elaborately for each of the passengers. As a result, the passengers can be prevented more reliably from missing the cars 5.

In the foregoing example, the information on the passenger traveling time periods is included in the personal information. However, information such as gender and age may be included in the personal information, and information on passenger traveling time periods corresponding to gender, age, and the like may be stored in the database 20. In this case, the passenger traveling time period calculation portion 21 reads from the database 20 that one of the passenger traveling time periods which corresponds to the personal information authenticated by the authentication device 31.

In each of Embodiments 1 to 3, and 7 of the present invention described above, the present invention is applied to the control system for the elevators which controls the plurality of the elevator apparatuses 1 to 3 comprehensively. However, the present invention may be applied to a control system for an elevator which controls a single elevator apparatus. In this case, the control system body 14 does not have the group supervision/control device 15. The control system body 14 is not required to select a selected elevator, so information from the landing call automatic registration portion 17 is directly input to the passenger traveling time period calculation portion 21.

As described above, in the control system for the elevator which controls the single elevator apparatus, when the elevator doorway (selected doorway) 6 is already in the door-open state at the time of registration of a car call by the landing call automatic registration portion 17, the door-open state of the elevator doorway 6 continues to be held until the passenger traveling time period elapses after registration of the car call. Therefore, the door at the elevator doorway 6 can be prevented from being closed before passengers reach the elevator doorway 6. As a result, the passengers can be prevented from missing the car 5.

The configuration of Embodiment 2 or 3 of the present invention described above may be applied to the configuration of Embodiment 4 of the present invention.

The invention claimed is:

1. A control system for elevators which controls operations of a plurality of elevator apparatuses each having a corresponding one of cars that can be stopped at common landing floors and corresponding ones of elevator doorways each provided at a corresponding one of the landing floors to serve for a transfer between the corresponding one of the cars stopped at the corresponding one of the landing floors and this landing floor, the control system being characterized by comprising:

a landing call registration device provided at each of the landing floors so as to be operable thereat;

a landing call automatic registration portion for setting that one of the landing floors at which the landing call registration device is operated as a car call floor, and registering a car call to stop any one of the cars at the car call floor;

a response selection portion for selecting, based on information from each of the elevator apparatuses and information from the landing call automatic registration portion, that one of the elevator apparatuses which responds to the registered car call as a selected elevator;

a passenger traveling time period calculation portion for setting, based on information from the response selection portion, that one of the elevator doorways of the selected elevator which is provided at the car call floor as a selected doorway, and calculating a passenger traveling time period required for traveling of a passenger from the landing call registration device to the selected doorway; and an opening/closing control portion for controlling an opening/closing operation of the selected doorway based on information from the selected elevator and information from the passenger traveling time period calculation portion, and characterized in that the opening/closing control portion continues to hold the selected doorway in a door-open state until the passenger traveling time period elapses after registration of the car call when the selected doorway is already in the door-open state at a time of registration of the car call.

2. A control system for an elevator which controls a single elevator apparatus having a car that can be stopped at landing floors and elevator doorways each provided at a corresponding one of the landing floors to serve for a transfer between the car stopped at the corresponding one of the landing floors and this landing floor, the control system being characterized by comprising:

a landing call registration device provided at each of the landing floors so as to be operable thereat;

a landing call automatic registration portion for setting that one of the landing floors at which the landing call registration device is operated as a car call floor, and registering a car call to stop the car at the car call floor;

a passenger traveling time period calculation portion for setting that one of the elevator doorways of the elevator apparatus which is provided at the car call floor as a selected doorway, and calculating a passenger traveling time period required for traveling of a passenger from the landing call registration device to the selected doorway; and an opening/closing control portion for controlling an opening/closing operation of the selected doorway based on information from the elevator apparatus and information from the passenger traveling time period calculation portion, and characterized in that the opening/closing control portion continues to hold the selected doorway in a door-open state until the passenger traveling time period elapses after registration of the car call when the selected doorway is already in the door-open state at a time of registration of the car call.

3. A control system for elevators according to claim 1, characterized by further comprising a door-open continuation limit time period determination portion for deciding a limit time period during which the selected one of the elevator doorways continues to be held in the door-open state as a door-open continuation limit time period, and characterized in that the response selection portion selects, based on the information from each of the elevator apparatuses and the information from the landing call automatic registration portion, a candidate elevator as a candidate for the selected elevator from the elevator apparatuses, sets that one of the elevator doorways of the candidate elevator which is provided at the car call floor as a candidate doorway, calculates a door-open continuation scheduled time period, which is obtained by adding the passenger traveling time period to a time period from a moment when the candidate doorway assumes a door-open state to a moment when the car call registration is made, when the candidate doorway is already in the door-open state at the time of registration of the car call, and compares the door-open continuation scheduled time period with the door-open continuation limit time period to determine whether or not the candidate elevator can be set as the selected elevator.

4. A control system for elevators according to claim 3, characterized in that the door-open continuation limit time period determination portion calculates the door-open continuation limit time period corresponding to a degree of crowdedness of the car call floor with the passengers.

5. A control system for elevators according to any one of claims 1 to 3, characterized in that the passenger traveling time period calculation portion calculates the passenger traveling time period corresponding to a degree of crowdedness of the car call floor with the passengers.

6. A control system for elevators according to claim 1 or 2, characterized in that:

the landing call registration device is an authentication device capable of acquiring personal information on the passengers to conduct personal authentication based on the personal information; and the landing call automatic registration portion makes the car call registration when each of the passengers is authenticated through the personal authentication.

7. A control system for elevators according to claim 6, characterized in that the passenger traveling time period calculation portion calculates the passenger traveling time period corresponding to the personal information on each of the passengers authenticated by the authentication device.

* * * * *